US005632932A

United States Patent [19]

Harris et al.

[11] Patent Number: 5,632,932

[45] Date of Patent: May 27, 1997

[54] DISTRIBUTION OF FINE BUBBLES OR DROPLETS IN A LIQUID

[75] Inventors: Ralph Harris, Westmount; Ruiqing Li, Pointe Claire, both of Canada; Albert E. Wraith, Northumberland, Great Britain

[73] Assignee: Martinex R & D Inc., Montreal, Canada

[21] Appl. No.: 605,055

[22] PCT Filed: Aug. 31, 1994

[86] PCT No.: PCT/CA94/00478

§ 371 Date: Mar. 15, 1996

§ 102(e) Date: Mar. 15, 1996

[87] PCT Pub. No.: WO95/06516

PCT Pub. Date: Mar. 9, 1995

[30] Foreign Application Priority Data

Sep. 2, 1993 [GB] United Kingdom ..... 9318241

[51] Int. Cl.[6] ..... B01F 3/04

[52] U.S. Cl. ..... 261/18.1; 261/76; 261/DIG. 75; 261/121.1

[58] Field of Search ..... 261/18.1, 76, DIG. 75, 261/121.1

[56] References Cited

U.S. PATENT DOCUMENTS

| | | | |
|---|---|---|---|
| 3,219,483 | 11/1965 | Goos et al. | 261/76 |
| 3,524,630 | 8/1970 | Marion | 261/76 |
| 3,540,474 | 11/1970 | Sharples | 137/559 |
| 3,544,078 | 12/1970 | Stupakis . | |
| 3,755,452 | 8/1973 | Sim et al. | 261/121.1 |
| 4,304,740 | 12/1981 | Cernoch | 261/121.1 |
| 4,351,730 | 9/1982 | Bailey et al. | 261/121.1 |
| 4,708,829 | 11/1987 | Bylehn et al. | 261/76 |

FOREIGN PATENT DOCUMENTS

| | | |
|---|---|---|
| 0191485 | 8/1986 | European Pat. Off. . |
| 237280 | 8/1911 | Germany . |
| 1962809 | 7/1970 | Germany . |
| 772344 | 4/1957 | United Kingdom . |
| 2221166 | 1/1990 | United Kingdom . |

*Primary Examiner*—Tim R. Miles
*Attorney, Agent, or Firm*—Swabey Ogilvy Renault

[57] ABSTRACT

Fine bubbles or droplets of a first fluid are dispersed in a liquid; a stream of a first fluid (10) is injected under pressure into a body of liquid (16), such stream having a lateral dimension relative to the direction of flow of the stream, which lateral dimension is elongate; a stream of a second fluid (12) is injected, under pressure into the body of liquid, which stream similarly has a lateral dimension relative to its direction of flow, which lateral dimension is elongate; the streams are injected such that a large two-dimensional interfacial contact area is established between the two streams; at least the second fluid is a liquid, the first fluid may be a liquid or a gas; the fine bubbles or droplets are produced with a lower energy requirement than prior art devices.

10 Claims, 4 Drawing Sheets

Fig. 2
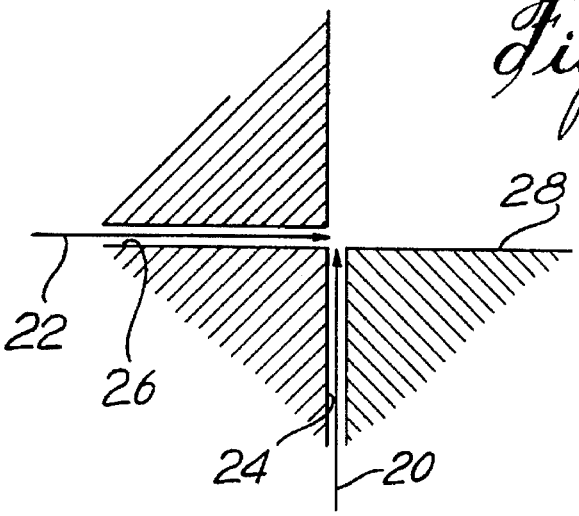
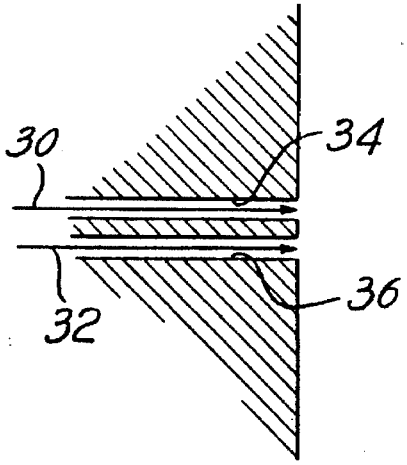
Fig. 3
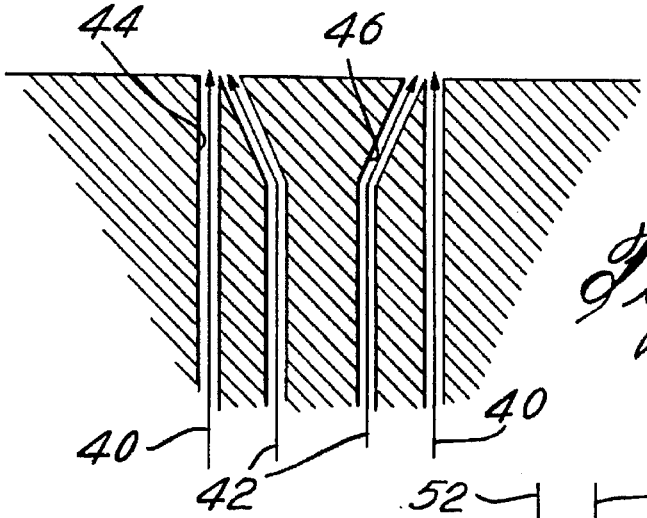
Fig. 4
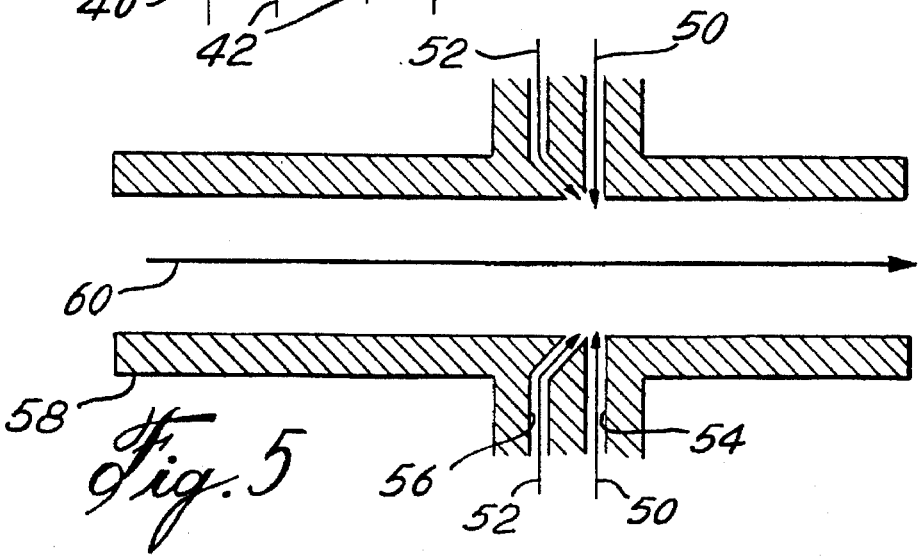
Fig. 5

DISTRIBUTION OF FINE BUBBLES OR DROPLETS IN A LIQUID

This invention relates to a method and apparatus for dispersing fine bubbles or droplets of a first fluid in a second fluid.

In particular the invention has application in the contacting of two fluids for the purpose of chemically reacting one fluid with the other or transferring species from one fluid to the other or to the creation of a dispersion of one fluid in the other.

In some instances, no chemical reaction or transfer of species is desired, but a change in a property of the resulting dispersion, for example, lowering heat transfer rates of the cooling water used in casting molds is required.

More especially, the invention is concerned with the creation of small gas bubbles or fluid droplets distributed uniformly throughout a liquid. It is commonly known that very fine distributions of the injected fluid are difficult to produce due to the strong tendencies of the dispersed fluid to coalesce; this invention produces fine distributions of a first fluid in a liquid while minimizing the coalescence and the amount of energy required. One benefit of the invention is that, for a given amount of energy input, the average bubble or droplet diameter is reduced to a minimum compared to other means of distribution and dispersion.

BACKGROUND ART

When a gas is to be distributed and dispersed in a liquid the common means of creating the dispersion fall into the following categories:

a) injection through circular orifices;

b) injection through porous plugs;

c) injection through rotating spargers; and d) injection with jet pumps, also known as venturi eductors or sometimes two-material injectors.

Each means has its own particular characteristic distribution of gas which depends on the initial size of the bubbles or droplets created at the point of injection and on the amount of coalescence occurring in the system. The tendency of a dispersion to coalesce is related to the physical properties of the two fluids and can be assisted by bulk fluid motion which brings droplets or bubbles together or gives rise to localized regions of lower pressure (cavitating) which assist the coalescence of the droplets or bubbles. In fact particularly with gas injection through a single orifice, porous plug or slot, creation of the dispersion itself results in bulk motion of the fluid which results in coalescence. Injection through rotating spargers or jet pumps is the usual means to counter this coalescence. Such devices provide strong mechanical agitation of the two phases and this results in a high degree of bulk fluid motion that can shear the coalesced bubbles or droplets into smaller sizes. In addition, the bulk fluid motion distributes the dispersed bubbles or droplets thereby decreasing the local density of the distributed phase and thus lowering the likelihood of the bubble-bubble interaction or the droplet-droplet interaction which leads to coalescence. Nevertheless, the resulting bulk motion causes localized lower pressure regions which results in coalescence and produces a wide range of bubble sizes. Thus a limitation of existing technology is that it does not produce very fine distributions of gas bubbles of a narrow size range. A further disadvantage of jet pump distribution techniques is that a large fraction of the bulk of the liquid is used in the pump to create the dispersion and thus very large amounts of energy are consumed.

DISCLOSURE OF THE INVENTION

Thus in one aspect the invention particularly contemplates a method of dispersing fine bubbles or droplets of a first fluid in a liquid comprising: providing a body of liquid, injecting a stream of a first fluid into said body of liquid, under pressure, said stream having a lateral dimension relative to the direction of flow of the stream, said lateral dimension being elongate, injecting a stream of a second fluid into said body of liquid, under pressure, adjacent said stream of first fluid, said stream of second fluid having a lateral dimension relative to the direction of flow of the stream, said later dimension being elongate, the injecting of the streams being such that a large two dimensional interfacial contact area is established between the stream of first fluid and the stream of second fluid, at least said second fluid being a liquid.

In another aspect of the invention there is provided an apparatus for dispersion of fine bubbles or droplets of a first fluid in a liquid comprising: a housing for a body of liquid, and fluid injection means including a first elongate fluid injection slot and a second elongate fluid injection slot, the slots being disposed for injection of adjacent streams of fluids into said housing such that a large two dimensional contact area is established between injected streams from said slots, within said housing.

BRIEF DESCRIPTION OF THE DRAWINGS

The invention is illustrated in particular and preferred embodiments by reference to the accompanying drawings in which:

FIGS. 2, 3, 4 and 5 each illustrate schematically apparatus of the invention for carrying out the process of the invention, with different arrangements of the injection slots;

MODES FOR CARRYING OUT THE INVENTION

In order to distribute a great number of widely dispersed very small gas bubbles or droplets of a first fluid through a nozzle into a receptacle containing bulk fluid, three conditions must be satisfied for the distribution nozzle: high flow rate of the fluid to be distributed, creation of small bubbles or droplets and wide dispersion of the distributed fluid to avoid coalescence.

Figure 1:
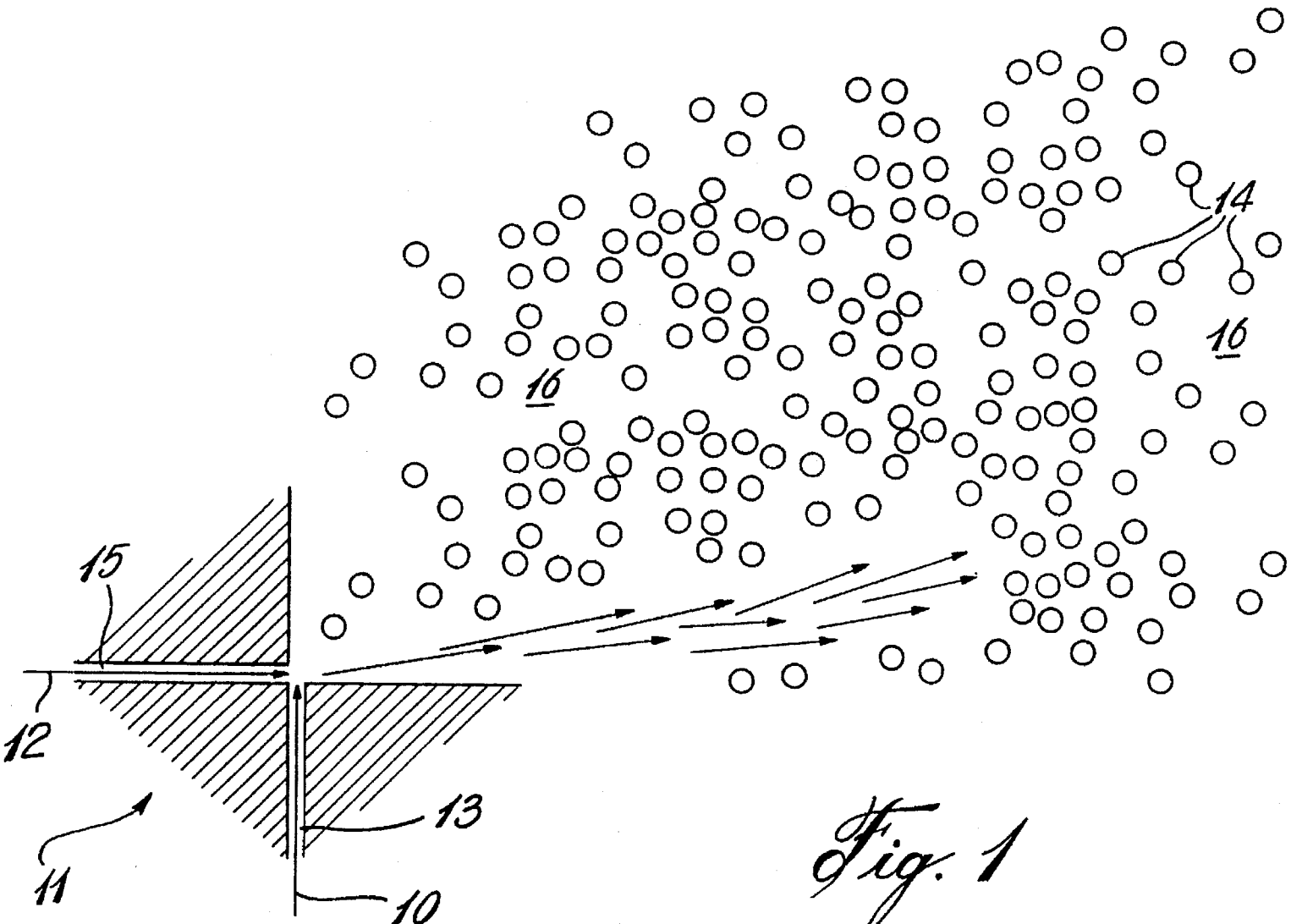
FIG. 1 illustrates schematically distribution of bubbles or droplets of a first fluid with a second fluid in a bulk liquid in accordance with the invention.

The present invention maximizes all three of these conditions. An example of a device to achieve this according to the present invention is depicted in FIG. 1 which shows a dispersed source gas distributor 11 comprising two narrow elongate slots 13, 15. In device 11, a first fluid 10 is injected in a stream through slot 13 and a second fluid 12 is injected in a stream through slot 15, into a bulk liquid 16 in which bubbles or droplets 14 of the first fluid 10 are generated.

In an experiment using the device of FIG. 1, under different conditions, air was injected through one slot as the first fluid and was impinged by a high speed two dimensional water jet, as the second fluid, produced by the second slot. Because gas and liquid were injected through slots, a large contact area between gas and liquid was obtained. The bubbles produced by the device were found to comprise a great number of fine bubbles having a diameter less than 2 mm. Table I identifies process parameters for the device based on FIG. 1, which devices had the following dimensions:

Gas slot spacing: 125 μm,

Liquid slot spacing: 50 μm,

Gas slot length: 10 cm,

Liquid slot length: 16 cm,

Gas and Liquid flow path length within slot opening: 1 cm,

Depth of gas slot between free surface of liquid: 20–25 cm.

TABLE I

| Gas Flow Rate slpm | Liquid Flow Rate l/min | Gas Superficial Velocity, m/s | Liquid Superficial Velocity, m/s |
|---|---|---|---|
| 1.8 | 8.6 | 2.4 | 18 |
| 3.6 | 8.6 | 4.8 | 18 |
| 7.2 | 8.6 | 9.6 | 18 |

Superficial velocity is the volumetric flow rate divided by the flow cross-sectional area.

The results demonstrate that by injecting first and second fluids separately through narrow slots adjacent to each other in accordance with the invention, such that a widely spread region of a mixture of the injected fluids is formed moving at high speed relative to the bulk fluid into which the fluids are injected, a minimally coalescing distribution of small droplets or bubbles with a narrow size distribution can be created.

Furthermore, it is found that the droplets or bubbles arise from the interface between the region of the moving mixture and the bulk fluid into which the mixture is introduced. In the experiments for which the parameters are set forth in Table I above, it was seen that the water that was injected formed a two dimensional jet penetrating into the bulk liquid. The water jet was seen to break up at the gas/liquid interface with formation of fine bubbles or droplets of the first fluid at the break up sites as a result of jet velocity profile rearrangement effects occurring at the interface between the two immiscible fluids moving relative to one another. It is possible that Helmholtz-Kelvin instability resulting from hydrodynamic interfacial instability of a jet-liquid interface may also play a role in the jet break up.

The characteristic wavelength for the break up of the jet is a strong function of the relative velocity difference across the interface, the higher the relative velocity, the shorter the characteristic wavelength. In the experiments, it was also seen that the air that was introduced through the slot adjacent to the water slot formed a continuous film that was accelerated by the water. As the water jet broke up, the thin gas film was broken into very small packets which were then introduced into the bulk liquid as small bubbles.

The invention permits the use of a high flow rate of the first fluid which is to be dispersed enabling the generation of a large number of widely dispersed very small bubbles or droplets of the first fluid.

The second fluid is injected at a pressure effective for penetration of the bulk liquid by the jet stream of the second fluid to a significant depth remote from the entry of the jet stream into the bulk liquid at the outlets of the slots, with establishment of the required large two dimensional interfacial contact area between the stream of second fluid and the stream of first fluid.

Thus, in the invention, the source of the finely divided droplets or bubbles is no longer localized to that of the physical device through which the fluid to be distributed is injected but, rather, the source is the interface between a region that is occupied by the moving mixture and the bulk fluid in which the distribution is desired. The invention thus involves the use of elongate slots which suitably are maximally extended in one dimension to achieve as wide a region of moving mixture of injected streams as possible.

In accordance with the invention the second fluid is a liquid and, in particular, is a liquid which is miscible with the bulk liquid. In many cases the second fluid will be the same as the bulk liquid or have the same character. For example, the second fluid and the bulk liquid may both be water, or the second fluid may be water and the bulk liquid may be an aqueous system, for example, an aqueous solution or aqueous suspension.

The first fluid which is to be dispersed in the bulk liquid may be a gas, in which case it will be dispersed in the bulk liquid as gas bubbles; or the first fluid may be a liquid in which case it will be dispersed in the bulk liquid as liquid droplets.

The first and second fluids are injected into the bulk liquid through separate elongate slots. The slot for the first fluid, which is to form the dispersed phase, suitably has a ratio of slot length:slot width of 300:1 to 6000:1. The slot for the second fluid, which is to form part of the dispersing phase, suitably has a ratio of slot length:slot width of 25:1 to 600:1.

In general the elongate slot for the first fluid has a length which is not greater than the length of the elongate slot for the second fluid; in other words the length of the elongate slot for the first fluid is less than or equal to the length of the elongate slot for the second fluid.

The slots for the first and second fluids may be disposed in various arrangements. FIGS. 2 to 5 are illustrative of some of the possible arrangements of the slots, however, other arrangements are possible.

In FIG. 2, the slots are arranged such that the direction of flow of the two fluids meet at a right angle to one another.

In particular the first fluid 20 is injected through an elongate slot 24 which is perpendicular to an elongate slot 26 for second fluid 22.

In the embodiment of FIG. 2 where the fluid 20 is a gas, the mixture of the injected stream travels along the surface 28. It is observed that for stable, small bubble generations some minimum length of surface 28 extending from the exit ports of the slots 24 and 26 is necessary. This minimum length appears to be about 1.5 cm.

In FIG. 3, the two slots are positioned such that the direction of flow of the two fluids is parallel. In particular first fluid 30 is injected through an elongate slot 34 which is parallel to an elongate slot 36 for second fluid 32. An advantage of this parallel disposition is that the exits for the first and second fluids can be in line without sacrifice to the stability of the operation of the apparatus at very high gas flow rates.

In FIG. 4, the two slots are positioned such that each slot forms an annulus and the directions of flow of the two fluids exiting the slots meet at some angle in the range from 0 to 180 degrees.

In particular first fluid 40 is injected through an annular slot 44 and second fluid 42 is injected through an annular slot 46 concentric with the annular slot 44.

FIG. 5 illustrates an apparatus of the invention in which the fluid to be distributed is injected adjacent to the second fluid through annuli arranged around the perimeter of a conduit carrying the bulk liquid as a flow.

In particular first fluid 50 is injected through an annular slot 54 and second fluid 52 is injected through an annular slot 56, into a conduit 58 through which a liquid 60 flows.

In particular embodiments the slots are perpendicular, parallel or in annular relationship or combinations of these.

Furthermore the invention contemplates injection devices incorporating a multiplicity of these slot arrangements, for example, the embodiment of FIG. 5 might employ a multiplicity of the pairs of slots 54 and 56, the pairs being disposed at spaced apart intervals along conduit 58 for bubble or droplet formation along the length of conduit 58, in liquid 60.

In one embodiment the housing is a conduit for flow of the body of liquid.

The body of liquid may be in an essentially static or quiescent state or it may be mobile under conditions of flow, these conditions of flow may be developed in different ways, for example, by gravity, by a pump disposed externally of the body of liquid, or an impeller disposed within the body of liquid. The flow of the second fluid may similarly be developed in different ways including those described for the flow of the body of liquid.

A large two dimensional interfacial contact area is established between the streams of first and second fluids which contact area has a width at the exit of the slots, which is at least equal to the lateral dimension of the stream of second fluid.

Another discovery was that coalescence of the distributed fluid was minimal due to three factors. The first of these was that the distributed fluid was widely dispersed thereby lowering the likelihood of interaction between the distributed fluid that leads to coalescence. The second was that, due to the uniformity of the size of the distributed fluid, the rise velocity of the distributed fluid was uniform with the result that there were few interactions between different parts of the distributed fluid rising at different speeds which further lowered the likelihood of interaction between the distributed fluid that would lead to coalescence The third factor was that motion of the bulk of the liquid in which the fluid was distributed was minimally non-rotational and as a result, the eddies that arise from rotary motion of the bulk fluid and cause coalescence were minimal.

The invention can be employed for the purpose of chemically reacting the first fluid with the bulk liquid, for transferring a species from the first fluid to the bulk liquid or for creation of a dispersion of the first fluid in the bulk liquid.

The transferred species can be chemically reacted with either of the fluids, for example, degassing of aluminum with chlorine gas, solvent extraction, oxygenation of cyanidation slurries, oxygenation of sewage, gas supply in genetic engineering bio-reactors, or it can be physically incorporated with one fluid or the other for example, flotation of minerals, degassing of aluminum, removal of dyes from paper pulp.

Particular areas in which the invention may be exploited include:

a) Degassing of aluminum:

Hydrogen which readily dissolves in molten aluminum must be removed prior to freezing the molten aluminum during casting in order to reduce the porosity of the cast product. One method to remove hydrogen and other impurities present in molten aluminum is to purge argon gas through the molten aluminum such that the dissolved hydrogen and other impurities are flushed out of the molten metal. The rate of hydrogen removal is greatly increased as the size of the purging gas bubbles is reduced. The present invention by producing bubbles of small size will facilitate degassing of aluminum.

b) Gas reduced heat transfer rates for the cooling water of aluminum casting molds:

At the start of casting of aluminum "jumbo" ingots, the rate of heat transfer needs to be reduced to obtain good quality product. One means to reduce the heat transfer rate is to introduce gas into the cooling water stream. A device according to the present invention may be employed in the pipe at the entry to the cooling water supply manifold to introduce small gas bubbles into the cooling water flow. The device may contain a series of gas and water injection slot pairs in series, each pair introducing a portion of the total amount of gas required. The gas and liquid slot pairs may be formed around the perimeter of the supply pipe such that there are annular openings.

c) Oxygenization during gold cyanidation:

The rate of gold cyanidation depends on the oxygen concentration of the solution in which the cyanidation is taking place. The present invention may be employed to achieve a high concentration of oxygen in the solution.

d) Sewage treatment:

In sewage treatment, the key factor in the design of gas distributor is the energy required to dissolve oxygen. Typical existing devices are able to dissolve oxygen at an energy input of about 2 kg oxygen per kWh of power. A device according to the present invention is able to dissolve oxygen at the rate of 10 kg oxygen per kWh of power.

e) Column flotation:

The performance of column flotation cells depends on the success of particle attachment and adherence to the bubbles of flotation gas rising through the pulp. The smaller the bubble size and the more uniform the bubble size and the bubble distribution, the better the performance. The present invention is thus particularly suited to the supply of the flotation gas to flotation columns since it produces uniform small bubbles widely distributed within the base of the column.

f) Bio-reactors:

The supply of uniformly distributed small gas bubbles to bio-reactors provides the conditions for development of the bio-reaction without harm to the organisms participating in the reaction. The present invention may be employed to create these small gas bubbles in the bio-reactor.

EXAMPLE

Gold cyanidation requires oxygen for gold dissolution. Since the gold containing slurry is rich in other oxygen consuming substances (sulphides, e.g. pyrrhotite), it is important to provide enough oxygen to allow complete gold dissolution within the residence time of the cyanidation reactors. It has been demonstrated that the rate of gold dissolution is directly proportional to the dissolved oxygen concentration of the mineral pulp which in turn is proportional to the oxygen partial pressure in the bubble. Yannopoulos, J. C., The Extractive Metallurgy of Gold, Van Nostrad Reinhold, New York, 1991, pp. 141–170; McLaughlin, J. D., Quinn, P. Agar, G. E. Cloutier, J. Y., Dube, G. and LeClerc, A., "Oxygen Mass Transfer Considerations for Cyanidation Rectors", Proc. 25th Ann. Meet. Canadian Mineral Processors, Ottawa, Ontario, Jan., 1993, CIMM, Montreal, paper 27, 1993; and Jara, J. O. and Bustos, A. A., "Effect of Oxygen on Gold Cyanidation: Laboratory Results", Hydrometallurgy, Vol. 37, pp. 195–210, 1992. Improving the rate of mass transfer of oxygen increases the dissolved oxygen concentration of the slurry and therefore improves the rate of the reaction.

The rate of mass transfer from a bubble to its surrounding solution increases with decreasing bubble size and increasing gas bubble residence time which in turn increases with decreasing bubble size. The generation and dispersion of small bubbles is thus critical to achieving high rates of mass transfer. Different configurations and devices used to inject gas have different effects on the bubble size and the residence time, influencing the overall rate of mass transfer. Therefore better mass transfer can be achieved by adopting a more efficient method.

The methods tested in this example are the four lance configuration (wall spargers), the inverted cone and a device of the invention, designated CD (co-injection device). The wall spargers and the inverted cone are used widely in the industry today.

THEORY

When oxygen is bubbled into an agitated vessel, the rate of mass transfer of the oxygen to the solution is described by the following first order equation:

$$\frac{dC_t}{dt} = -K_L a(C_t - C^*) \quad (1)$$

where:

$K_L$=overall liquid phase mass transfer coefficient, m/s;

a=interfacial area per unit volume $m^2/m^3$;

C*=equilibrium liquid phase dissolved oxygen concentration, ppm;

$C_t$=bulk liquid phase dissolved oxygen concentration at time t, ppm.

Integration of Eqn. 1 results in the following relationship between oxygen content and time:

$$\ln\left(\frac{C_t - C^*}{C_o - C^*}\right) = -K_L a t \quad (2)$$

where:

$C_O$=initial dissolved oxygen concentration, ppm.

Assuming that the equilibrium dissolved oxygen content was negligible allows $K_L a$ to be obtained from the slope of the $\ln(C_t/C_o)$ vrs time plot. The term, $K_L a$, is called the overall mass transfer coefficient and is often used to evaluate the mass transfer rates and compare one configuration to another. An increase in the magnitude of $K_L a$ indicates an increase in the rate of mass transfer indicating that the process is more effective and more economical since less gas would be necessary and/or smaller reaction volumes would be required. The present experiments focused on determining which device generated the highest $K_L a$.

EXPERIMENTAL

All experiments were performed in a 140 liter cylindrical plexiglass vessel that had a diameter of 600 mm and held 500 mm of water. Four vertical baffles having 55 mm width were placed vertically at 90° angles around the side of the wall. Mixing was provided by an impeller rotating at 186 RPM. The impeller was 200 mm in diameter, with four blades 45 mm wide, pitched at 45°. The lances had an inner diameter of 4 mm and an outer diameter of 6 mm and were attached to the baffles. The end of each lance was 100 mm from the bottom of the tank and 100 mm from the wall. The cone was 100 mm high by 100 mm wide and had 24 teeth 5 mm high. The CD was 50 mm diameter and placed 10 cm below the eye of the impeller. The CD was also tested without the impeller. The gas flow rate was measured using a Hastings Mass Flowmeter (model 201). Oxygen content was measured with a Cole Palmer dissolved oxygen meter (model 5513-60).

The gas flow rates chosen for this study were based on a criterion of the same superficial gas velocity in the prototype and full scale tanks. Thus, the gas flow rates, 0.04 l/s and 0.4 l/s, injected into the 140 liter (600 mm diameter) vessel match 25 SCFM and 250 SCFM for a 785 $m^3$ (10 m diameter) vessel in plant.

The vessel was filled with water which was then saturated with dissolved oxygen by bubbling oxygen. Nitrogen was then injected through one of the devices and the decrease in oxygen content with time of nitrogen bubbling was recorded. The nitrogen injection was not continuous. It was performed for a certain time interval and then stopped to allow the reading on the oxygen meter to stabilize while the tank continued to be agitated. The time necessary for the stabilization of the reading was about one minute. Thus the cumulative injection time was used in the semi-log plots. In the plots, it was assumed that C* was equal to zero because the equilibrium oxygen concentration in water sparged with nitrogen is zero.

RESULTS AND DISCUSSION

Figure 7:
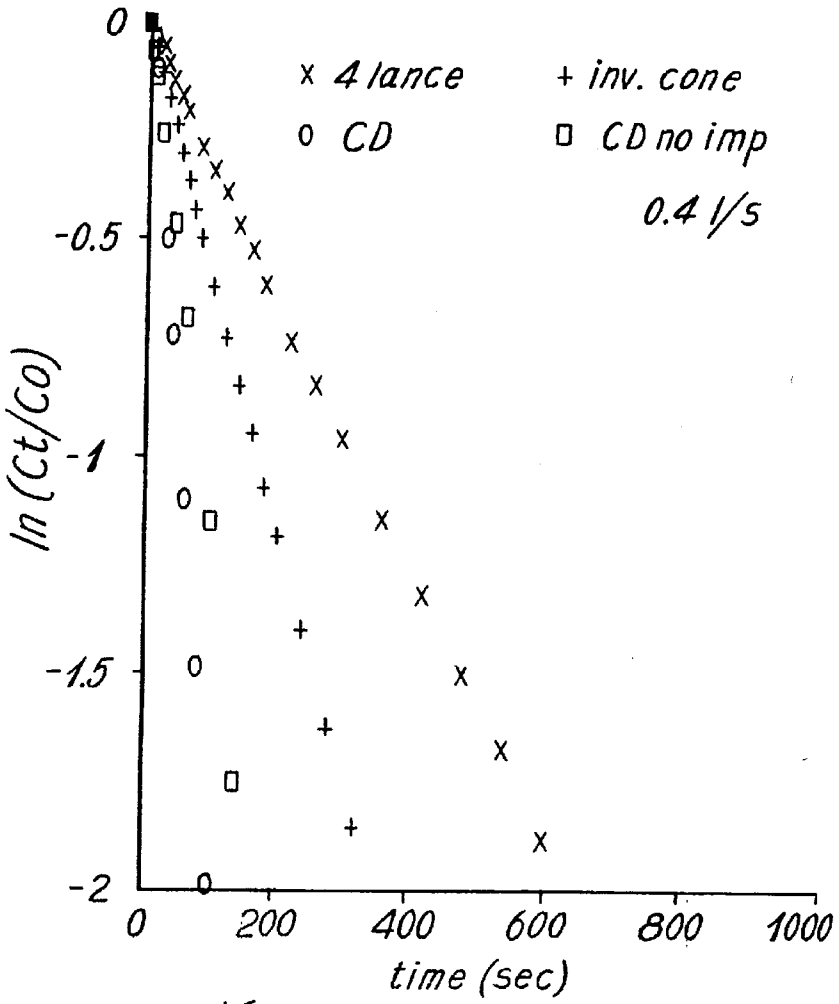
FIG. 7 is a plot similar to FIG. 6 with 0.4 l/s nitrogen injections.
Figure 6:
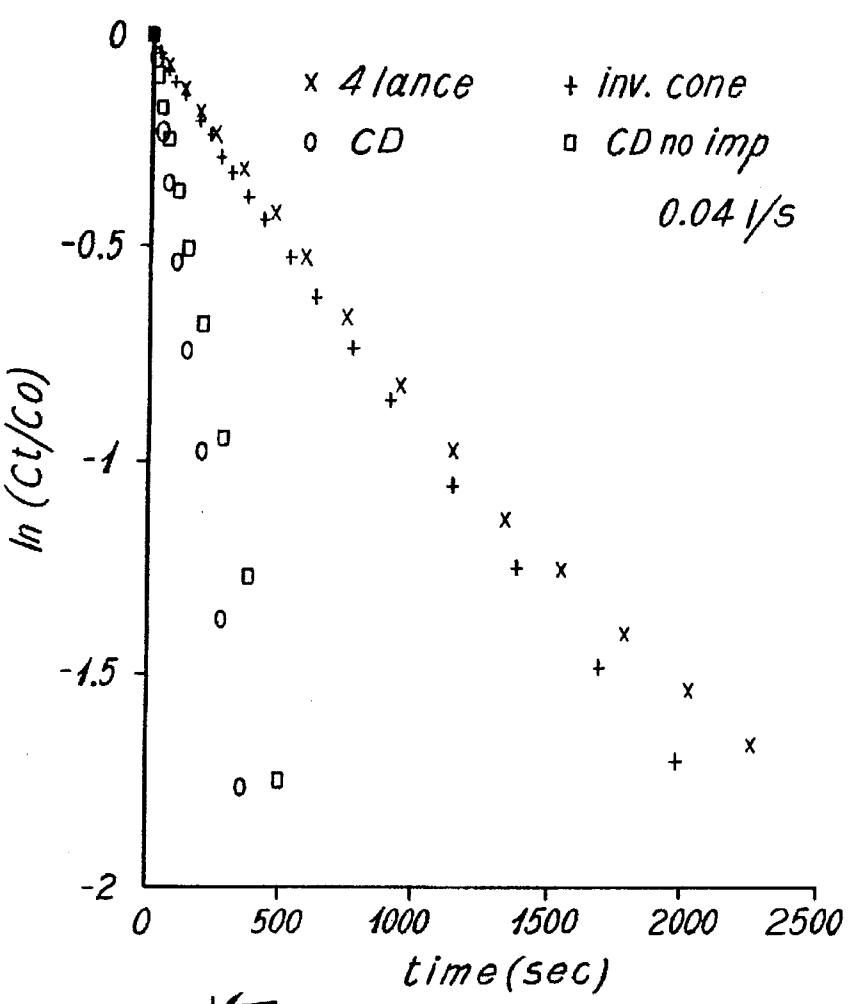
FIG. 6 is a plot of oxygen concentration (desorption) v time results for mass transfer experiments with 0.04 l/s nitrogen injection.

FIGS. 6 and 7 show the decrease in dissolved oxygen concentration with time of nitrogen injection, as nitrogen was injected through the various devices in different configurations. The nitrogen flow rate was 0.04 l/s for FIG. 6 and 0.4 l/s for FIG. 7. From FIGS. 6 and 7, it can be seen that the CD with the impeller had the fastest decrease in dissolved oxygen concentration at both 0.04 l/s and 0.4 l/s. $K_L a$ values were calculated from the initial straight portion of the curves.

Table 2 shows the overall mass transfer coefficients ($K_L a$) for the various devices at a gas flow rate of 0.04 l/s. The ratio of $K_L a_{CD}/K_L a$ was used to compare the efficiency of the CD over the other devices. Table 3 provides the same information as Table 2 but for a gas flow rate of 0.4 l/s. Table 2 includes the value for $K_L a$ when no gas is injected but mixing is provided by the impeller and water recirculation. From Tables 2 and 3, it can be seen that the CD was the most efficient device in terms of $K_L a$ at both the high and low gas flow rates. The mass transfer coefficient for the CD was about 2 times greater than that of the inverted cone with water recirculation; and 3 to 6 times better than the inverted cone (without water recirculation) which is considered the best in the industry. The CD was also 6 times better than the four lance configuration without water recirculation which was the least efficient method of gas supply.

Figure 8:
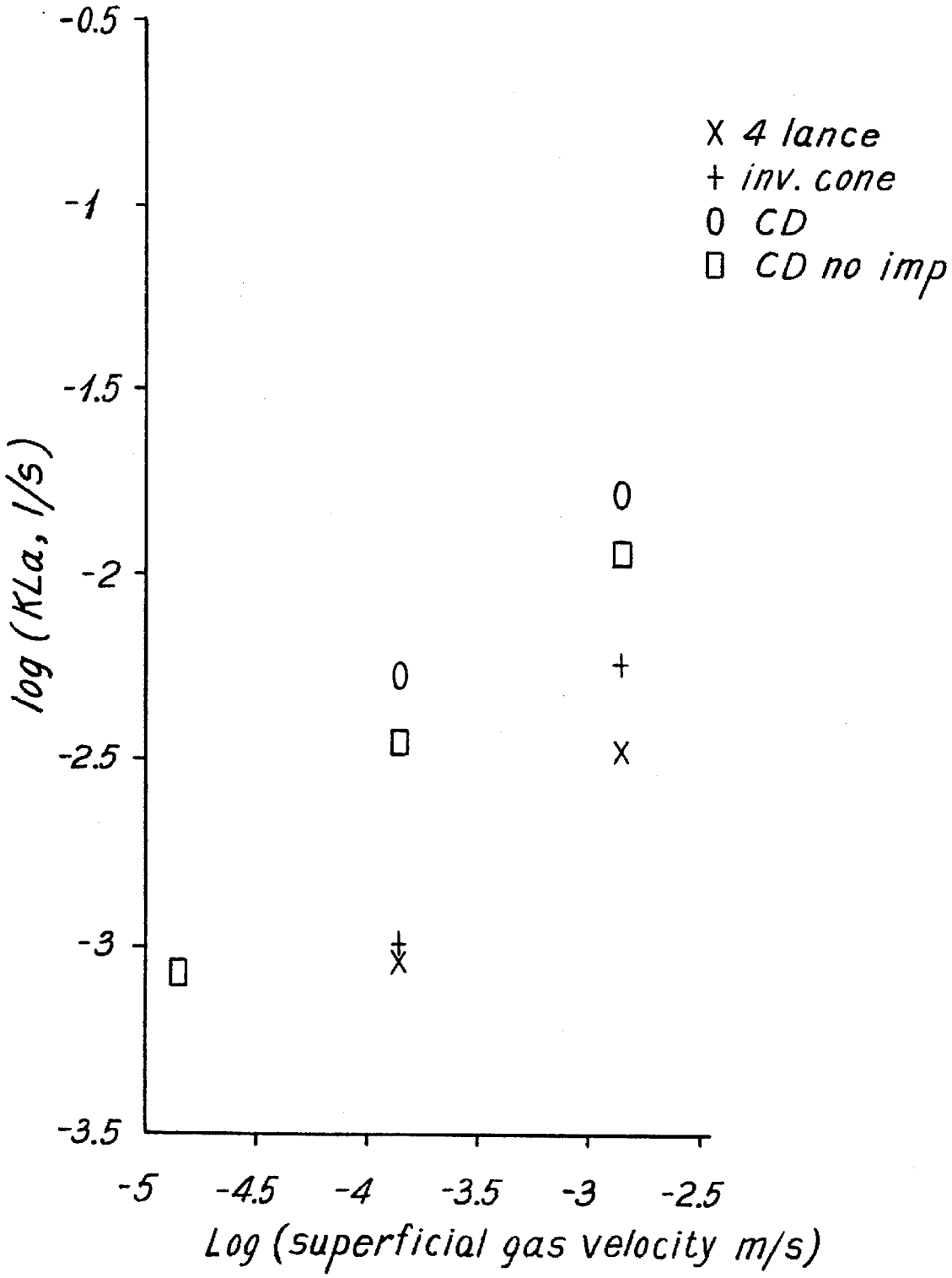
FIG. 8 is a plot of $K_La$ values against superficial gas velocity in a model cyanidation tank.

It can be seen from Tables 2 and 3 that the CD without the impeller is less efficient, but it still offered the second best performance. FIG. 8 summaries the present work on a plot of $\log(K_L a)$ vs log (superficial gas velocity). A linear dependence between the logs of the variables plotted can be seen and it can be seen.

TABLE 2

Overall Mass Transfer Coefficient ($K_La$) for Oxygen desorption in water by nitrogen injection through the different devices. $K_La$ for various devices at a gas flow rate of 0.04 l/s.

| DEVICE: | $K_La(S^{-1})$ | $K_La_{HCD}/K_La$ |
|---|---|---|
| CD | $-4.9*10^{-3}$ | 1 |
| CD no impeller | $-3.4*10^{-3}$ | 1.4 |
| 4 lances | $-7.6*10^{-4}$ | 6.4 |
| inverted cone | $-8.7*10^{-4}$ | 5.6 |
| impeller with no nitrogen injection | $-1.8*10^{-4}$ | 26.5 |

TABLE 3

Overall Mass Transfer Coefficient ($K_La$) for Oxygen desorption in water by nitrogen injection through the different devices. $K_La$ for various devices at a gas flow rate of 0.04 l/s.

| DEVICE: | $K_La(S^{-1})$ | $K_La_{HCD}/K_La$ |
|---|---|---|
| CD | $-2.0*10^{-3}$ | 1 |
| CD no impeller | $-1.2*10^{-2}$ | 1.7 |
| 4 lances | $-3.1*10^{-3}$ | 6.5 |
| inverted cone | $-5.8*10^{-3}$ | 3.4 |

Visual observations revealed that with the CD device gas dispersion extended more uniformly throughout the reactor volume and no large bubbles were observed.

The CD with the impeller was the most efficient configuration. At high and low gas flow rates, the performance of the CD without the use of the impeller was decreased, but it was still better than that of the other devices. Using the CD, instead of the four lances or the inverted cone results in a substantial increase of the mass transfer rates.

We claim:

1. A method of dispersing fine bubbles or droplets of a first fluid in a liquid comprising:

providing a body of liquid, injecting a stream of a first fluid into said body of liquid, under pressure, said stream being developed at a first slot having a ratio of slot length: slot width of 300:1 to 6,000:1, injecting a stream of a second fluid through a second slot into said body of liquid, adjacent said stream of first fluid, under a pressure effective for penetration of said body of liquid to a depth remote from said second slot, said second slot having a ratio of slot length: slot width of 25:1 to 600:1, the injecting of the streams being such that an interfacial contact area is established between the stream of first fluid and the stream of second fluid, remote from the slot, said interfacial contact area comprising bubbles or droplets of said first fluid having a diameter less than 2 mm, at least said second fluid being a liquid.

2. A method according to claim 1, wherein said body is of said second fluid.

3. A method according to claim 1, wherein said first fluid is a gas.

4. A method according to claim 1, wherein said first fluid is a liquid.

5. A method according to claim 1, wherein said stream of second fluid is permitted to break up as a result of jet velocity profile rearrangement effects, at said interfacial contact area with formation of said bubbles or droplets of said first fluid at the break up sites.

6. A method according to claim 1, wherein said body of liquid is under flow.

7. A method according to claim 1, wherein said first slot has a slot length less than or equal to the slot length of said second slot.

8. An apparatus (11) for dispersion of fine bubbles or droplets of a first fluid (10) in a liquid (16) comprising:

a housing for a body of liquid (16), and fluid injection means including a first fluid injection slot (13) and a second fluid injection slot (15), said first slot (13) having a ratio of slot length: slot width of 300:1 to 6,000:1 and said second slot (15) having a ratio of slot length: slot width of 25:1 to 600:1, the slots (13,15) being disposed for injection of adjacent streams of fluids (10,12) into said housing such that an interfacial contact area is established between injected streams from said slots (13,15), within said housing, remote from the slots, and said fluid injection means being adapted to inject a first fluid (10), under pressure, through said first slot (13) and a second fluid (12) under pressure, effective for penetration by the stream of second fluid (12) from said second slot (15), to a depth remote from said second slot (15).

9. An apparatus according to claim 8, wherein said housing is a conduit (58) for flow of the body of fluid.

10. An apparatus according to claim 8, wherein said first slot (13) has a slot length greater than or equal to said second slot (15).

* * * * *